US006997888B2

(12) United States Patent
Rehrig

(10) Patent No.: US 6,997,888 B2
(45) Date of Patent: Feb. 14, 2006

(54) LIBIDO STIMULATING DEVICE AND METHOD OF USING

(76) Inventor: Glenn A. Rehrig, 421 Lafayette Ave., Palmerton, PA (US) 18071

( * ) Notice: Subject to any disclaimer, the term of this patent is extended or adjusted under 35 U.S.C. 154(b) by 0 days.

(21) Appl. No.: 10/191,570

(22) Filed: Jul. 8, 2002

(65) Prior Publication Data

US 2004/0006291 A1 Jan. 8, 2004

(51) Int. Cl.
*A61H 19/00* (2006.01)

(52) U.S. Cl. ..... 601/70; 601/134; 601/136; 600/38

(58) Field of Classification Search ..... 601/70, 601/72, 73, 97, 101, 135, 137; 433/6, 118, 433/119; 600/38; 128/859, 842, 844, 860, 128/861
See application file for complete search history.

(56) References Cited

U.S. PATENT DOCUMENTS

| | | | | | |
|---|---|---|---|---|---|
| 3,991,751 | A | * | 11/1976 | O'Rourke | 601/72 |
| 3,996,930 | A | * | 12/1976 | Sekulich | 601/137 |
| 4,139,006 | A | | 2/1979 | Corey | 128/127 |
| 4,790,296 | A | | 12/1988 | Segal | 128/51 |
| 4,949,731 | A | | 8/1990 | Harding | |
| 5,067,480 | A | | 11/1991 | Woog et al. | 128/32 |
| 5,318,043 | A | | 6/1994 | Burr et al. | |
| 5,470,303 | A | | 11/1995 | Leonard et al. | 601/84 |
| D368,140 | S | | 3/1996 | Hopper | D24/215 |
| 5,582,187 | A | | 12/1996 | Hussey | 128/857 |
| 5,649,549 | A | | 7/1997 | Saba | 128/842 |
| 5,657,765 | A | | 8/1997 | Est | 128/842 |
| 5,690,603 | A | | 11/1997 | Kain | 600/38 |
| 5,720,302 | A | * | 2/1998 | Belfer | 128/859 |
| 6,056,705 | A | | 5/2000 | Stigar-Brown | 601/84 |
| 6,059,717 | A | | 5/2000 | Dabney | 600/38 |
| 6,099,463 | A | | 8/2000 | Hockhalter | 600/38 |
| 6,179,775 | B1 | | 1/2001 | Thompson | 600/38 |
| 6,251,066 | B1 | | 6/2001 | Pack | |
| 2002/0068900 | A1 | | 6/2002 | Barnes et al. | |

FOREIGN PATENT DOCUMENTS

| | | |
|---|---|---|
| DE | 24 60 812 | 7/1976 |
| DE | 26 06 869 | 9/1977 |

* cited by examiner

*Primary Examiner*—Michael A. Brown
*Assistant Examiner*—Quang D. Thanh
(74) *Attorney, Agent, or Firm*—Charler A. Wilkinson; Clinton H. Wilkinson

(57) ABSTRACT

A device to facilitate interpersonal stimulation pursuant to the practice of cunnilingus during sexual foreplay includes two main portions, (a) a generally egg shaped or other arcuately or oval shaped surfaced section, (b) a generally half conical shaped trough section attached to the arcuately shaped surfaced section at the small end of the trough shaped section arranged to accommodate the tongue of one party in the (b) section when the (a) section is inserted in a body orifice. A crosspiece at the outer end of the trough enables the chin of one party to urge the (a) end of the device deeper into a body orifice.

29 Claims, 3 Drawing Sheets

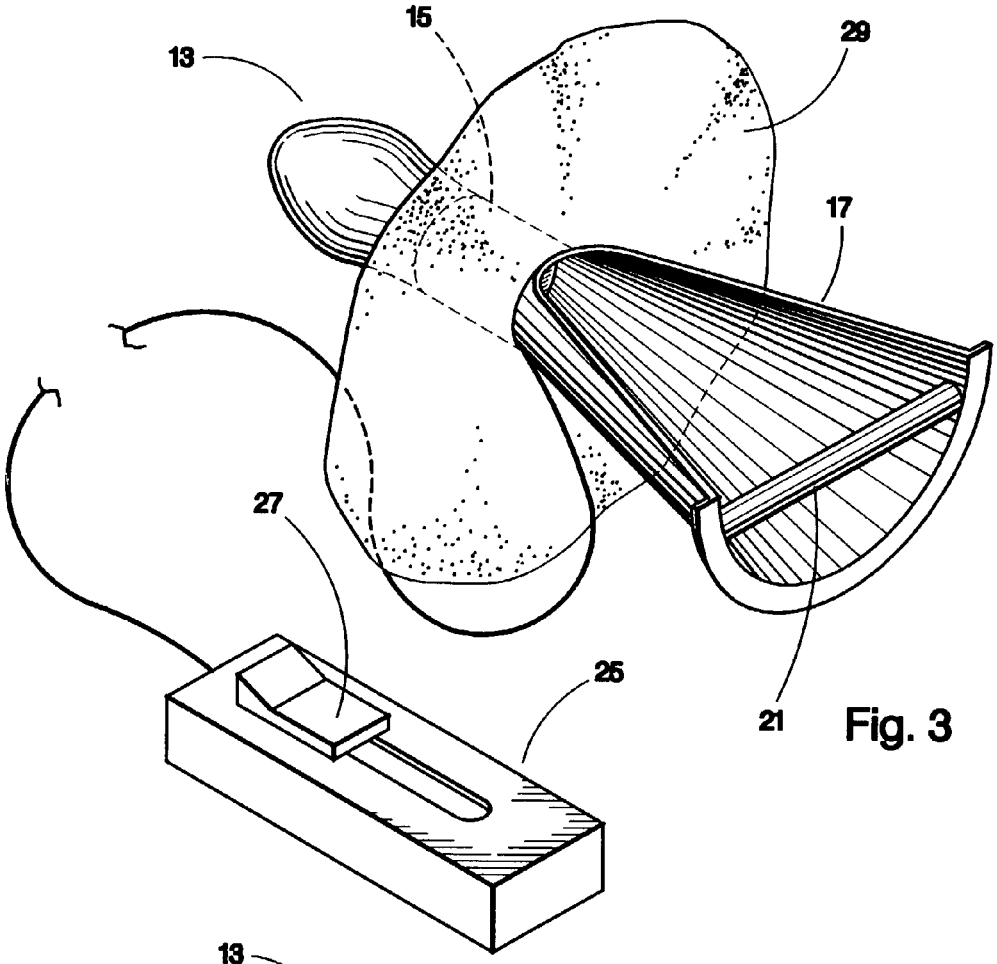
Fig. 3
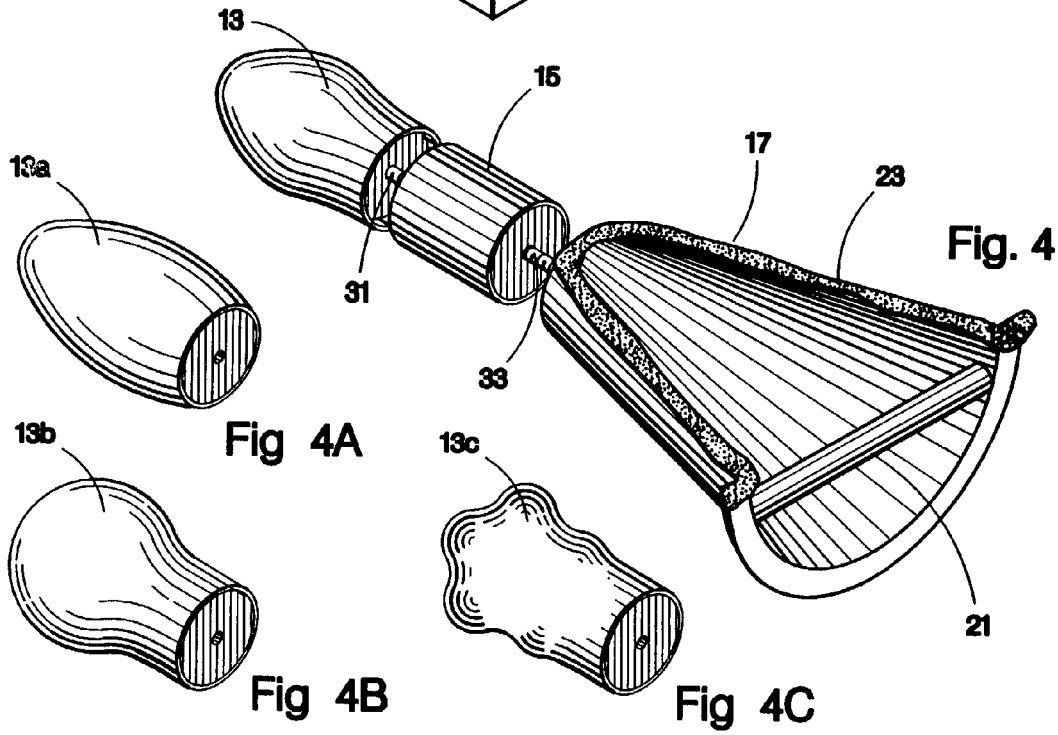
Fig. 4
Fig 4A
Fig 4B
Fig 4C

LIBIDO STIMULATING DEVICE AND METHOD OF USING

The invention is related to sexual well being promoting devices and more particularly to a device to aid in increasing mutual arousal of two parties during foreplay in order to increase the effectiveness and enjoyment of subsequent sexual relations.

GENERAL PRELIMINARY DISCUSSION

It is becoming more and more recognized that a healthy productive lifestyle is particularly important for healthful living. Included in such lifestyle is the very important factor of sexual relations. Satisfactory sexual relations are now recognized as a very important part of a healthy lifestyle both with respect to social interactions and with respect to physical well being.

It is also becoming more and more recognized that different people are subject to different needs and desires and, furthermore, have a right to pursue such needs on a consensual basis. Consider, for example, the incorporation of the so-called gay lifestyle into the mainstream even though there still remains considerable prejudice with respect to individual parties. However, our society is moving inexorably from a unimoral atmosphere in which the activities individuals can legally and morally participate in depends upon what those in power, of whatever sort, hand down to those with less power, to a pluralistic moral milieu in which many varied types of activity are acceptable. Where sexual partners, including particularly married partners, are oriented to or pursuing the same activities, particularly in foreplay, the best overall relationships tend to occur where the parties can enjoy the same activities to the fullest extent. However, where the activities the partners enjoy are diametrically opposite or even merely somewhat at cross purposes, difficulties tend to brew, unless the parties take turns in fulfilling the other's needs. Such on again, off again, activities are frequently not too satisfactory, however, because sex is basically a rapidly progressing paroxysmal activity that can be easily interfered with or derailed and when interrupted may not be easily resumed. Moreover, frequently the parties keep their needs to themselves in keeping with the general human tendency to perform sex in private, a tendency which undoubtedly aids in retaining the primary bonding between persons of the opposite sex and decrease conflict generally within society, particularly between males, but is sometimes not conducive to mutually satisfactory sexual relations.

The present invention is a mutually stimulating sexual-arousing device particularly useful in so-called cunnilingus. Almost all animals lick the genitalia of the opposite sex and particularly the female genitalia. Many members of human society follow the same practice. A fairly large group of individuals in fact find cunnilingus quite stimulating. Both men like to lick the female genitalia and women enjoy having their genitalia licked as a portion, or part, of foreplay, i.e. activities leading up to actual intercourse. In a lesser group the roles are reversed, but the dominant group has the male lick the female genitalia and, in fact, those who engage in this practice believe this is a more "natural" activity.

As noted, one of the deep bonding elements between men and women as marriage partners is a mutually enjoyable sex life as well as having children, similar interests and the like. Consequently, anything that heightens sexual pleasure between partners, perhaps the epiphany of having similar interests, is clearly a desirable aim or end. The present invention is directed to the attainment of such mutual sexual aims among a fairly large group of adults.

The present inventor is not aware of any device similar to his mutual stimulatory device, which is fairly simple in its basics, consisting of a small oval or otherwise curvilinear forward component that is adapted to be placed just within the mouth of the female vagina with its major axis in line with the longitudinal extent of the vagina. Attached to one end of such curvilinear body is a more or less triangular scoop shaped tongue guide and support into which a male partner or even in the case of lesbian activity a cooperating female partner can place or flick his or her tongue as the mood strikes the active participant. The tongue is thereby guided along the decreasing section of the scoop toward the entrance of the vagina; in effect "making every tongue movement count." Toward the outer end of the scoop shaped guide is preferably either a wall extending across the cross section of the scoop shaped guide or alternatively a cross piece that allows the man or active participant to place his chin against the back of the device to both force the curvilinear section into the female vagina and thereafter to apply a gentle forward force upon the device gently forcing open the labia or lips and exposing the female clitoris. In some cases such chin rest may be used also to vibrate or pulsate the mutual stimulation device of the invention by forward thrusts of the man's chin, thereby arousing powerful feelings of arousal in the female partner. However, in most cases the primary arousal and pleasure engendering action in the female is pressure upon or manipulation of the clitoris, which is not surprising as it is the direct anatomical analog of the male sex organ having an identical embryological origin.

In an alternative embodiment of the invention the curvilinear member which is entered into the female vaginal canal may have an internal vibrator to even further stimulate the vagina and heighten arousal. Such vibrations tend also to be transmitted through adjacent tissues into the clitoris where major stimulation may occur. The device of the invention not only provides means for internal stimulation of the vagina and to direct the tongue of a partner toward the vagina, but also tends to expose the clitoris for active stimulation during foreplay.

DESCRIPTION OF PRIOR ART

The inventor is aware of the following prior devices having some isolated features similar to individual features of the invention.

U.S. Pat. No. 4,139,006 issued to A. E. Corey on Feb. 13, 1979, entitled "Female Incontinence Device," discloses a device for controlling female urinary incontinence which, as best shown in FIGS. 3 and 4, is inserted completely in the vagina of the female. It is designed to press the wall of the vagina toward the pubic bone and constrict the urethra between the two. While the Corey device is not designed for sexual stimulation, it does illustrate a generally triangularly shaped device for insertion into the vagina, although obviously in a completely different manner from the present invention.

U.S. Pat. No. 4,790,296 issued to D. A. Segal on Dec. 13, 1988, entitled "Sexual Stimulation Apparatus," discloses a vibrational device for use with alternative heads for use either fitted over the penis of a man or inserted into the vagina of a woman. The Segal device broadly discloses the use of vibratory devices for sexual stimulation and relief, but is otherwise unlike the present invention.

U.S. Pat. No. 5,067,480 issued to P. E. Woog et al. on Nov. 26, 1991, entitled "Stimulator," discloses a vibrational and stimulator device which can use a variety of stimulator heads which can in turn be oscillated through eccentric internal rotation at a wide range of vibrations per minute. The device is said to be useful for so-called orgasmic therapy for women depending upon self-stimulation. It is explained that a head for such stimulator need not be phallic shaped in order to be effective. The Woog device discloses the use of vibratory devices for sexual stimulation, but is otherwise unlike the present invention.

U.S. Pat. No. 5,470,303 issued to C. D. Leonard et al. on Nov. 28, 1995, entitled "Massage Device," discloses a hand held massage or "vibratory device" provided preferably with a tongue shaped vibratory end for use by women. The head is formed of soft rubber and has a rotary member on a circulatory progressing rod contained in it to allegedly provide a realistic vibration or pulsation. Leonard references a variety of previous vibratory devices and particularly references the Woog et al. patent for the need for self-stimulatory devices for women. It also illustrates a tongue shaped stimulator, but is obviously not an aid to natural tongue stimulation.

U.S. Pat. No. 5,582,187 issued to C. L Hussey on Dec. 10, 1996, entitled "Protective Mask," discloses a thin latex shield for use during oral sex or cunnilingus to prevent the transfer of sexually transmitted diseases through direct contact. The Hussey reference is an example of the use of an aid to cunnilingus basically in the form of a prophylactic shield and is broadly representative of a plurality of similar devices, many of which are cited in the Hussey patent. There is little other resemblance to the present invention, however.

U.S. Pat. No. 5,649,549 issued to G. M. Saba on Jul. 22, 1997, entitled "Contraceptive Device for Oral Sex," discloses a device having a latex body portion (12), a softer latex layer (30) disposed within an opening in the central portion of the body portion, and a pair of wings (40). In use, the device is placed over the female genitalia, with the soft layer covering the vagina area. Adhesive strips (24 and 42) on the body and wing portions are used to secure the device to the skin of the female, and the female can be stimulated through the soft latex layer without direct bodily contact. While the Saba device could be thought of as enhancing the pleasurability as well as the desirability in performing oral sex on a female, it does not provide a means for exposing the clitoris as in the present invention.

U.S. Pat. No. 5,657,765 issued to S. S. Est on Aug. 19, 1997, entitled "Erotic Stimulator," discloses an oversize artificial tongue simulator with a mouthpiece similar to an athletes protective mouth-piece at one end griping the artificial tongue and stimulating the female genitalia while leaving the hands free during gynecological stimulation with the device.

U.S. Pat. No. 5,690,603 issued to M. M. Kain on Nov. 25, 1997, entitled "Erogenic Stimulator," discloses a phallic simulator having an oval end which may contain a vibrator, the thin neck enables the device to be held in place by the wearers normal musculature without the need for special straps or the like. The device is said to be usable both vaginally and anally.

U.S. Pat. No. 6,056,705 issued to K. R. Stigar-Brown on May 2, 2000, entitled "Clitoral Clip," discloses a pliers-type tool, which, as shown in FIG. 3, in use surrounds the clitoris, and provides vibratory stimulation to the female. It does not, however, provide easier access to the female in order to provide manual or other stimulation.

U.S. Pat. No. 6,059,717 issued to J. C. Dabney on May 9, 2000, entitled "Sexual Aid," discloses a sexual aid having a wider arrow-shaped head portion and a narrower neck portion. Dabney does not include a funnel-shaped portion attached to the opposite end of the neck portion. The Dabney device is also designed for insertion into the anal canal to detect contractions incident to orgasm, but does not or is not intended to stimulate the party into whom it is inserted. The device apparently has no tongue stimulation aspects.

U.S. Pat. No. 6,099,463 issued to R. Hockhalter on Aug. 8, 2000, entitled "Female Stimulator Comprising Close-Fitting Clitoral Suction Chamber," discloses an alternative means for providing clitoral stimulation using a suction device. While the suction means is disclosed as being either oral or mechanical, Hockhalter does not disclose a means to facilitate access to the clitoris.

U.S. Pat. No. 6,179,775 issued to R. J. Thompson on Jan. 30, 2001, entitled "Device to Enhance Clitoral Stimulation During Intravaginal Intercourse," discloses a generally triangularly shaped pad (10) which is narrower at upper end (14) than at lower end (16). In use, as shown in FIG. 6, U-shaped notch (24) contacts the underside of the clitoris, preventing downward motion of the clitoris during penetration, which apparently provides additional stimulation to the female. While Thompson discloses a very recent clitoral stimulation device, such device is designed to be used during intercourse rather than foreplay.

U.S. Design Pat. No. 368,140 issued to G. Hopper on Mar. 19, 1996, entitled "Portable Hand-Held Vibratory Feminine Stimulator," discloses an ornamental design for a hand-held vibrator having a head portion designed to simulate the lips and tongue of a human. Presumably, such device vibrates and/or is movable in some manner. While Hopper discloses a female stimulatory device, it does not disclose a device similar to the present invention for providing easier access to the clitoris to provide for manual or tongue stimulation. It is, therefore, similar to the Leonard et al. patent noted above.

None of the prior art known to the Applicant provides any device similar to or operating in a similar manner as that of the present Applicant.

BRIEF DESCRIPTION OF THE INVENTION

A cunnilingus-facilitating device is composed of two main portions (a) a curved or oval and preferably egg shaped head member designed to smoothly enter the female vagina attached to the smaller end of (b) a trough-like semi-conical structure. The trough-like semiconical structure preferably has an open larger end with a transverse bar across the upper portion. An electrically or otherwise operated vibrator may be contained in the curved or arcuate head member structure. The device may be also provided with a thin protective cover surrounding the intersection of the trough-like member and the arcuate or curved head member structure. The device is used by inserting the curved or egg shaped member into the female vagina and then flicking or darting the tongue of a partner down the trough-like member to impinge upon the opening of the vagina and particularly the clitoral area to stimulate mutual arousal.

BRIEF DESCRIPTION OF THE DRAWING

FIG. 3 is an isometric view of the stimulatory device of the invention incorporating an extra thin flexible shielding material between the trough-like portion and the arcuate head as a disease preventive or protection.

FIG. 4 shows the sections of the device partially unscrewed so to speak allowing the thin shield shown in FIG. 3 to be set in place and alternative sized or shaped arcuate heads to be mounted upon the apparatus.

DESCRIPTION OF THE PRINCIPLE EMBODIMENTS

Figure 1:
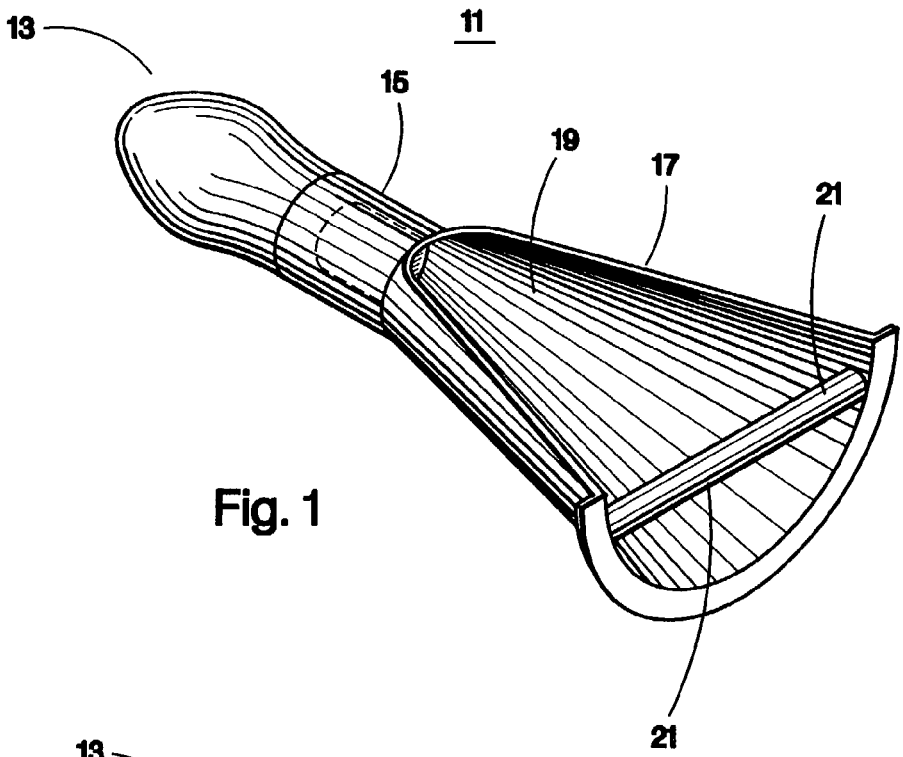
FIG. 1 is an isometric view of a preferred apparatus of the invention.

The present invention provides a sex stimulation, or mutual stimulation device which is effective to mutually stimulate both a man and a woman sexually provided they are accustomed to and wish to practice cunnilingus or licking of the primary sex organs of the woman by the man or, in a same sex situation, of the primary sex organs of a woman by another woman. While some women enjoy this activity and others perhaps merely tolerate it for the enjoyment of their partners, the activity is quite natural as shown by the fact that almost all animals' practice it and a considerable number of humans also practice it. As such it is one of the alternative sex practices, which are indulged in by humans and, when enjoyed by both partners, have a very broad bonding effect upon the partners and are therefore both socially and medically desirable.

More particularly the present invention is designed primarily to be used during sexual foreplay to enhance the sexual stimulation of a female, although it also provides additional stimulation to many males. The device has essentially three parts: an oval or egg-shaped head portion, a narrowed neck portion, and a body portion which is at least partially funnel-shaped with approximately one-half of the funnel cut away. The head portion is designed to be inserted into the female vagina such that the cut away portion of the body is facing upwardly, thereby forming a surface to accommodate the chin and mouth as well as the tongue when extended of a sexual partner. As the device is pushed farther into the vagina, the funnel shape of the body portion will gradually push the female labia outwardly, fully exposing the clitoris, which can then be more easily directly stimulated with the tongue or even by some other means such as the hand. The oval or egg-shaped head and narrowed neck design helps to keep the device in place during use. The head portion may also in a somewhat preferred embodiment be designed to vibrate, thereby increasing the overall stimulatory effect of the device. The head portion may in some cases take the general shape of an unconstricted glands or end portion of the penis of a male without however being cloven on the ventral surface. However, this is by no means necessary or even preferred since the main function of head is to retain the device in the vagina of the female partner while pressing inwardly with the tapered sides of the half funnel shaped section to gradually force open the labia and expose the female's clitoris.

The length of the funnel portion of the device will preferably be longer than the extension of the usual human male tongue and will have as small a convergence angle as possible or allowed by the length of the trough. The funnel section may be inserted into the female vagina as deeply as is comfortable for the female to open the labia as far as possible and at this position the tongue of the man or male should preferably just reach the vagina or the base of the labia or more particularly the clitoris. It is preferred for the conical portion of the apparatus to be uniformly angled from one end to the other. However, the taper may also be varied or variable so that the lips of the labia are displaced to the side or opened more rapidly at one point or degree of insertion than another. Thus, since it is usually desirable for the labia to be pressed open slowly and gently, it may be desirable for the lower portion of device to have a lesser convergence than the convergence of the section that normally remains outside the body or in non-contact with the female partner. The length of the conical portion should usually be at least 2.5 to 3 inches in length to accommodate the usual male extended tongue length. However, this may be variable with the actual tongue length of any individual user.

The use of the device of the invention has been found to be very arousing to the usual woman accustomed to cunnilingus and mutually arousing in most cases to both partners. The device of the invention can be used in several different embodiments including a vibrating apparatus to vibrate the head portion, and/or having a protective shield arranged to prevent direct contact between the mouth of the one party and the genitals of the other party and a version where the size and or shape of the head portion can be changed to vary the stimulatory factor in different vaginas and the like.

FIG. 1 is an isometric view of the principle embodiment of the mutual stimulatory device 11 of the invention in which there is a forward curvilinear member 13 having a major longitudinal axis and expanded curvilinear dimensions in other directions. This curvilinear body is designed to be inserted into the outer end or head of the vagina of a woman past its intersection with a second generally cylindrical section and up to intersection with a third generally scoop shaped or trough shaped body 17 having a generally increasing cross sectional area from its attachment with three dimensionally curvilinear member 13 as shown in FIG. 1 which extends from the vagina and provides a smooth depressed inner surface 19 into and along which the partner of the woman involved may insert his or her tongue used as a stimulatory organ. An intermediary portion or neck 15 of generally cylindrical configuration serves to connect the two major portions 13 and 17 of the device 11. A transverse preferably rounded rest member 21 provides a rest for the chin of the woman's partner against which the partner's chin may be rested and provide a resistant surface through which the partner may exert a gentle pressure to gradually open or force apart the lips or labia better exposing the clitoris of the woman. In some cases the woman's partner may exert thrusting movements of the partner's chin which serve to thrust the head 13 of the device against resistance from the vagina very much in the way the head of a male penis, the shape of which the head 13 broadly simulates may make thrusting movements during intercourse and particularly during and leading up to ejaculation. However, in most cases, particularly since the device is intended for use in foreplay and not as a substitute for the major or final portion of the sex act, the chin of the partner will merely be used to gently force the half conical portion of the device through or between the labia gradually opening them and disclosing the clitoris.

Figure 2:
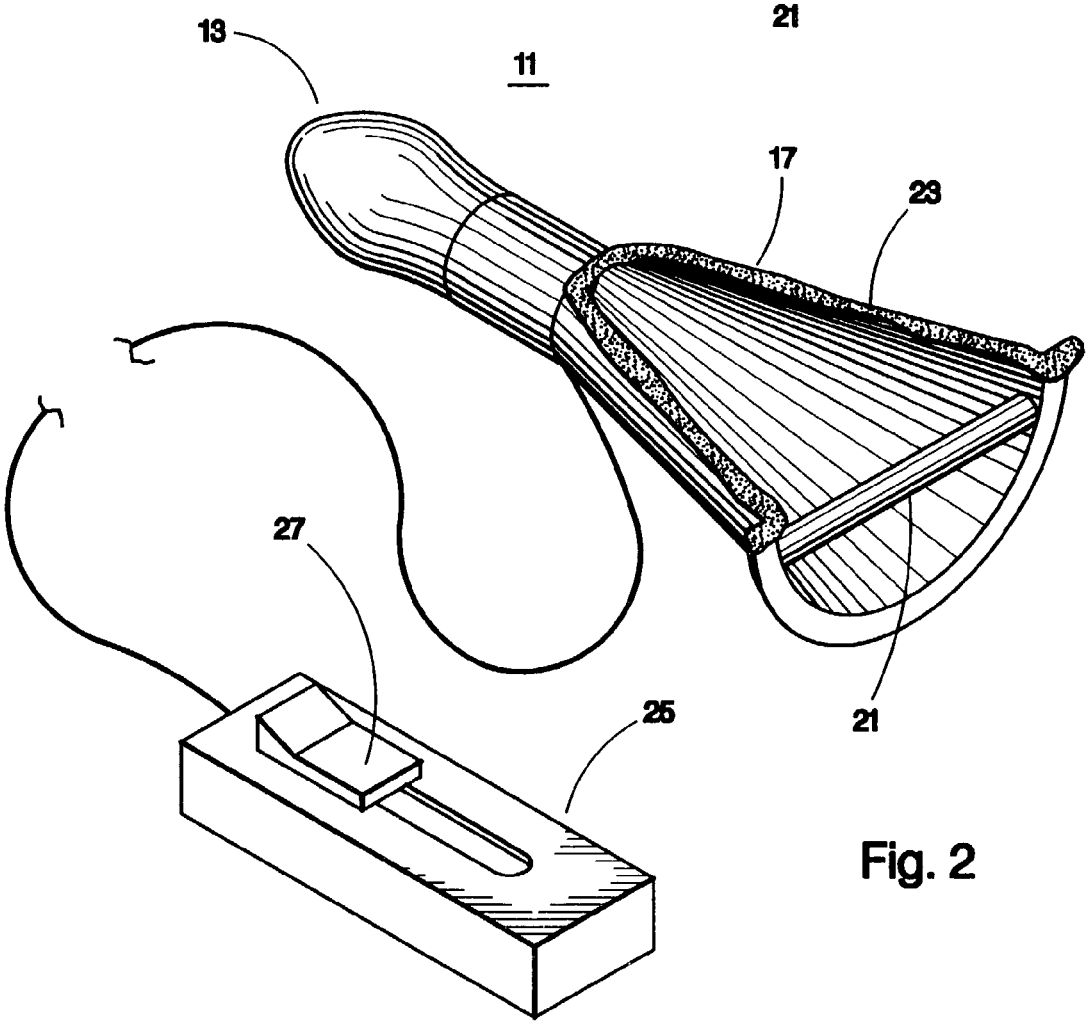
FIG. 2 is an isometric view of the apparatus of the invention including a battery and control case for operating a vibrator in the arcuately curved or egg shaped end of the apparatus and also having a soft padding about the upper portion of the trough-like member.

FIG. 2 is an isometric view of an alternative embodiment of the invention in which a padded top edge 23 of the trough-like member is provided to avoid abrading of the tongue and other mouth parts of the party using their tongue and mouth parts. Such padding may be of a semi-soft rubbery composition or flexible plastic or the like. The device is also provided with a battery and control box 25 for control of a vibrator apparatus, not shown, contained in the head 13 of the device. Such vibratory apparatus is old and well known in the sexual stimulation art. As will be understood, the switch 27 of the control box may be moved to alternative positions along the box to operate the vibratory apparatus at varies speeds or levels as well as to turn it completely off. Other than for the ability to vibrate the head of the stimulator when desirable the operation of the device of FIG. 2 is identical to that shown in FIG. 1. It will be understood in this regard that in both such devices the insertion of the head of the device into the vagina will tend to spread the lips of the vagina or labia, better exposing the clitoris of the woman so that it can also be stimulated either by the tongue of the woman's partner or by one of the fingers of the woman's partner or even for that matter by the woman's own hand. The device of the invention, therefore, not only has the function of stimulating through the vagina and better directing the tongue of a cunnilingus partner to the primary sex organs, but also better exposing the clitoris of the woman by spreading the labia.

FIG. 3 shows a further embodiment of the invention in which a further thin shield material 29 is provided between sections 15 and 17 of the device to form a shield when in use and prevent direct contact between the sex organs and the mouth parts of the partners. Obviously such a shield member will not normally be used by married partners, except if one is a known carrier of a sexual disease. However, in these disease prevalent times less than permanent partners frequently wish to take prophylactic measures and the shield 29 provides a practical measure. The shield can be fairly stiff and self supporting like a splash shield, but will usually be flexible and depend upon the care of the partners in arranging it between them for its effectiveness.

FIG. 4 shows a further embodiment of the invention in which the sections 13 and 15 are attached to each other and to section 17 through a central screw threaded member or members 31 and 33. This not only allows the two outer members 13 and 15 to be unscrewed and a shield 29 such as shown in FIG. 3 placed between sections 15 and 17 over the threaded member as shown in FIG. 3, but also allows for alternative head sections 13 to be installed. Such alternative sections, several of which are shown at 13*a,* 13*b* and 13*c* in FIG. 4, may be of varying size and shape in recognition that the vaginas of some women are more capacious than others and may react more positively to different sizes and surface configurations of heads. Also heads of different materials may be used, some harder or softer than others depending upon the preference of the woman. An older woman with a more easily damaged vagina after, for example, menopause, may prefer a softer head than a younger woman, and a woman who has given birth may prefer a larger head section 13 than a woman who has not. In each case the intersection of the head section with the shaft section should be the same size or diameter so that there will not be a step between the two which could be quite irritating to the mucus membranes of the user. It will be understood that the sections 13 and 15 are shown partially unscrewed so to speak and that they would be securely locked together or even made in one piece in actual use. The screw fastenings provide a convenient way to mount the shield 29 shown in FIG. 3 or the alternative stimulator heads shown to the lower left of FIG. 4 as well as to provide for the alternative use of various sizes, shapes and surface characteristics of stimulatory heads.

Figure 5:
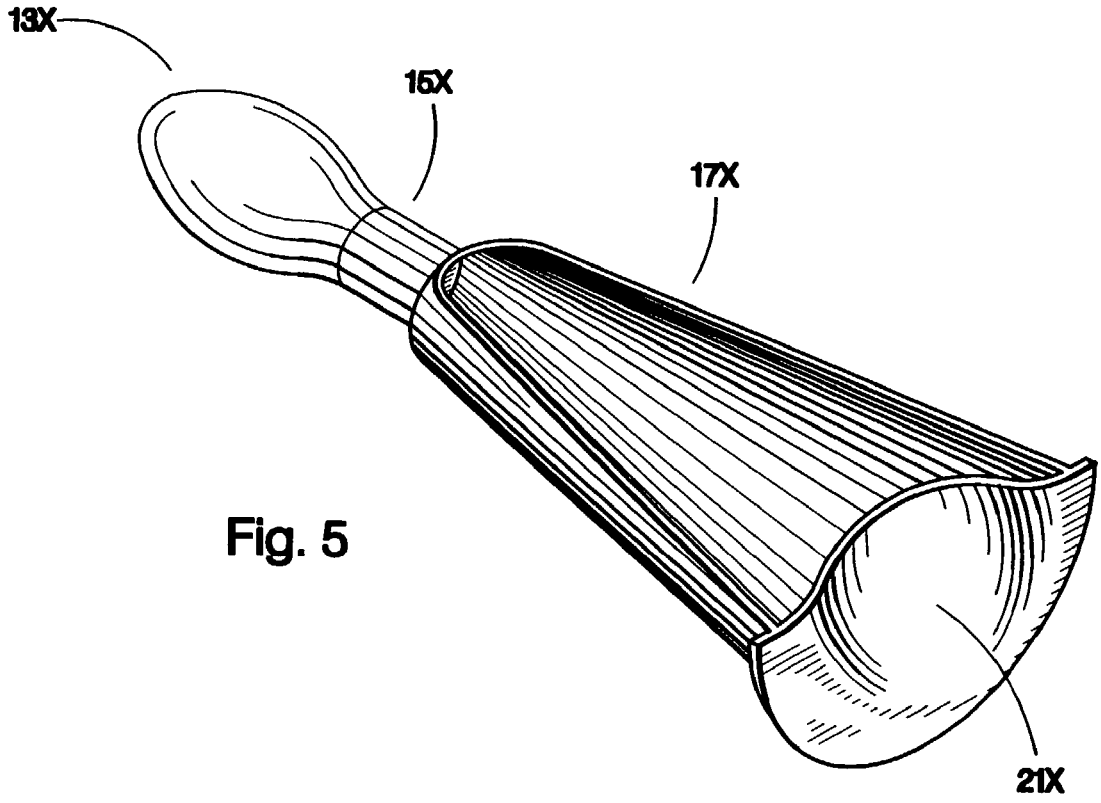
FIG. 5 is an isometric view of a further embodiment of the stimulatory device of the invention incorporating a wall or dam at the rear of the device having a shape designed to accommodate the chin of the active partner.

FIG. 5 shows a further embodiment of the invention wherein while the device is overall of the same length the section 15*x* is not only thinner but also shorter so that the lesser length is compensated by a longer trough section 17*x* which also has a more rapidly increasing, blunter end which tends to more strongly stimulate the female sex partner as it is pressed against and between her labia. Alternatively, the section 17*x* could have a more slowly converging or inclined configuration providing an earlier and more gentle urging aside of the labia to reveal the clitoris. In addition, the rear end 21 of the half funnel section 17*x* is closed and molded to assume the shape of a male chin, making it more comfortable as well as its movements more controllable by the male at least in so far as the contour reasonably matches the contour and size of the chin of the particular male using it.

It will be understood that the present invention provides a very useful mutual stimulating apparatus or device that is both easy to use and effective in increasing mutual stimulation between partners. In using the device the male partner after having inspected the apparatus will, near the beginning, but preferably not as a commencement of mutual stimulatory activity, gently insert the head 13 of the device in his partner's vagina. He will then, using his chin and in some cases, as explained above, back and forth thrusting movements of his head and particularly his chin, move the device into the vagina or, alternatively, back and forth in the vagina simulative of a human penis' movement, and can at the same time for his own enjoyment and that of his partner thrust his tongue in the trough section toward his partner's primary erogenic organs gently licking them and, dependent upon the preference of his partner, also stimulating the clitoris of his partner, which will have been exposed by the spreading of the labia by the device of the invention. By these measures intense pleasure is provided to those partners who are positively oriented toward this type of display or activity.

It will be further understood that while a cross piece 21 has been shown and is generally preferred for the partner to rest his or her chin on to move the device gently into the vagina (after first having it set by hand usually at least partway into the vagina) various other arrangements for the chin could be provided. For example, as shown in FIG. 5, the upper or outer section of the half conical section can be completely closed or walled off providing in this manner a means for resting the chin upon. In addition, the cross piece or closed off section could be desirably inwardly curved or contoured in the shape of a shallow depression to better and more comfortably accommodate the chin of the woman's partner again as shown in FIG. 5. Furthermore, if the partner prefers to manually move the device as necessary in a longitudinal direction into the vagina during foreplay as well as during actual placement or starting into the vagina, the extra means for accommodating the chin can be dispensed with completely.

It will also be understood that just as the arcuate end of the device can take alternative curved shapes, that the trough-like member can have various shapes and configurations. For example, it can be shallow or deeper, be unevenly half conical, perhaps decreasing in diameter more rapidly in some sections than in others. In addition, the trough can be flattened particularly on the inside. In general, however, the shape of the trough should provide a gradually increasing size outwardly or decreasing size inwardly over a reasonable length which will accommodate the average human tongue when extended from the mouth and effective from the outside to gradually spread the lips of the vagina at least in opposite directions and preferably from three directions as the device is gently pressed deeper into the vagina.

The device will generally be made of plastic materials, but could be made of any material which is at least liquid resistant and sufficiently rigid to maintain its shape. Preferably it will be formed of hypoallergenic materials sufficiently heat resistant to be washable in boiling water for sanitary purposes. The material or materials of construction should also be able to provide a smooth durable external surface or surfaces to prevent undue irritation to sensitive mucus membranes. Hard rubber, polyethylene, polypropylene and other plastic materials or even light metals such as aluminum-magnesium or the like may be used and such materials may be composites such as, for example, a hard plastic core material with a somewhat flexible plastic or rubber over coating. Other compositions and constructions will occur to those skilled in the art.

In accordance with the invention it may be broadly stated that the interpersonal stimulator of the invention, comprising a first smoothly contoured generally curved surface vaginal insert, is first manually inserted into the vagina or other body orifice of a first party by either the first party or a second party and the device is then gently further pressed into the vagina subsequent to its first entrance into the vagina by gentle chin pressure against the outer end of the trough-like member exerted preferably against a chin rest of some form by the second party. Such gentle pressure, because of the gradually increasing cross sectional area of the trough-like member, will tend to gently press the labia of the female partner apart better exposing the clitoris which can then be directly stimulated by the tip of the tongue of the male partner or digitally stimulated simultaneously. Meanwhile, the tongue of the second or male party can be flicked or thrust toward and into the opening of the vagina along the guiding trough in one side of the trough-like section which should not be shorter than the extended tongue of the average user of the device or more preferably any likely user of the device. The flicking and thrusting of the tongue of the second party can be accompanied by simultaneous digital stimulation or touching of the clitoris and other external portions of the vaginal area and may also be accompanied by vibrational stimulation of the vagina area and particularly the associated clitoris adjacent to the vagina at the entrance thereto, provided, of course, that the stimulatory device is provided with a vibrator.

It will be evident from the foregoing that there has been invented a very effective and efficient facilitator of mutual sexual stimulation for those persons that are oriented toward cunnilingus or associated sexually oriented activities. Furthermore, such facilitator of mutual sexual stimulation can be made inexpensively of various molded materials and is easily adaptable to related activities.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A method of mutual stimulation between at least temporary sexual partners making use of a facilitating device comprising:

(a) providing a facilitating device comprised of an expanded volume curved surface vagina insert, and a tongue accommodating trough in a decreasing cross sectional area member, (b) inserting the vaginal insert into a body orifice of a first party, (c) extending the tongue of a second party within the trough while pressing the vaginal insert further into the body orifice of the first party, and (d) stimulating a portion of the body orifice of the first party with the tip of the tongue of the second party.

2. A method of mutual stimulation in accordance with claim 1 wherein the tongue accommodating trough is in a generally decreasing cross sectional area member from the outer end of the decreasing cross sectional area member to the expanded volume curved surface vaginal insert and the decreasing cross sectional area member is used to pry open the labia exposing the clitoris of the first party and said clitoris is physically stimulated by the second party.

3. A method of mutual stimulation in accordance with claim 2 wherein the vaginal insert is pressed more deeply into the vagina of the first party gradually opening the labia to expose the clitoris of the first party by chin movement of the second party against an outer element of the tongue accommodating trough while the clitoris is physically stimulated by the second party.

4. A method of mutual stimulation in accordance with claim 1 wherein a vibrator apparatus adapted for vibrating the expanded volume curved surface vaginal insert is operated during extension of the tongue of the second party toward and into contact with the first party.

5. An interpersonal stimulation device comprising:

(a) first a three dimensionally curvilinearly contoured exterior surface shaped portion, (b) an increasing area trough shaped portion having an increasing cross sectional area over a substantial length of the trough shaped portion, (c) the three dimensionally curvilinearly contoured exterior surface shaped portion being attached to the increasing area trough portion throught a narrowed neck portion at the smaller end of the trough shaped portion, (d) the interior of the trough-shaped portion having a smooth interior surface being adapted for receiving a human tongue and guiding said tongue directly toward the narrowed neck portion during interpersonal relations.

6. An interpersonal stimulator device in accordance with claim 5 additionally comprising: (e) a chin contact portion at the outer larger end of the trough shaped portion opposite the narrowed neck portion arranged to allow forward movement of the device in line with the two portions (a) and (b) by forward movement of a human chin.

7. An interpersonal mutual stimulation device in accordance with claim 6 wherein the trough shaped portion has a length from one end of the trough shaped portion to the other end of the trough shaped portion at least somewhat longer than the length of the tongue of an average male human.

8. An interpersonal mutual stimulation device in accordance with claim 7 wherein the trough shaped portion has a length more than about 2.5 to 3 inches in length.

9. An interpersonal stimulation device in accordance with claim 8 wherein the three dimensionally curvilinearly contoured exterior surface shaped portion is equipped with an electrically operated vibration means.

10. An interpersonal stimulation device in accordance with claim 7 wherein there is a flexible shield member positioned between the three dimensionally curvilinearly surface shaped portion and the trough shaped portion in the vicinity of the narrowed neck portion for blocking the transfer of possible disease causing elements between users of the interpersonal stimulation device.

11. An interpersonal stimulation device in accordance with claim 7 wherein different three dimensionally curvilinearly surface shaped portions can be interchangeably attached to the trough shaped portion.

12. An interpersonal stimulation device in accordance with claim 6 wherein the chin contact is a cross piece extending across the outer larger end of the increasing area trough shaped portion.

13. An interpersonal stimulation device in accordance with claim 6 wherein the chin contact is a wall across the outer larger end of the increasing area trough shaped portion having a contour to generally receive the chin of a user of the device.

14. A stimulation device for use during sexual foreplay comprising:

(a) a first smoothly contoured section having a three dimensional curvilinear shape and size adapted for placement and retention within the outer portion of the vagina of a first party, (b) a second smoothly contoured section having a generally increasing cross sectional area with a trough-shaped depression, the increasing cross sectional area disposed over a substantial length of the trough-shaped depression and adapted to support and guide the tongue of a second party toward the clitoris of the first party, (c) the first and second smoothly contoured sections being secured to each other through a narrowed neck section adjacent to the smaller end of the increasing cross sectional area of the second smoothly contoured section.

15. A stimulation device in accordance with claim 14 wherein there is a chin contacting member at the larger end of the trough-shaped depression.

16. A stimulation device in accordance with claim 15 wherein the chin contacting member is in the form of a crosspiece extending from one side of the trough-shaped depression to the other.

17. A stimulation device in accordance with claim 15 wherein the chin contacting member takes the form of a contoured rear section at the rear of the trough-shaped depression.

18. A stimulation device in accordance with claim 17 wherein the length of the trough-shaped depression as well as the second smoothly contoured section is greater in length than the length of the tongue extending from the mouth of an average user of the stimulator device.

19. A stimulation device in accordance with claim 15 wherein various alternative contour first sections may be attached to the second section.

20. A stimulation device in accordance with claim 19 wherein the first section is provided with a mechanical vibration device.

21. A stimulator device in accordance with claim 14 wherein there is a flexible plastic shield member between the first and second sections extending outwardly in a position to prevent moisture and any contained disease causing organisms contained in such moisture from passing from one of the parties to the other.

22. A stimulation device for use during sexual foreplay between a first and second party comprising:

(a) a first smoothly curvilinearly contoured section having a three-dimensional curvilinear shape and size adapted for insertion into a genital opening of a first party, (b) a second smoothly contoured section attached to one end of the first smoothly contoured section and having a generally increasing in cross sectional area over a substantial length of the second smoothly contoured section from its attachment with the first smoothly contoured section, (c) said second smoothly contoured section having a trough shaped depression at least partway along one side allowing access of the tongue of a second party toward the genital opening of the first party, and (d) a narrowed neck section between the first three-dimensional curvilinear shaped section and the second smoothly contoured section.

23. A stimulation device for use during foreplay between a first and second party in accordance with claim 22 additionally comprising:

(e) a chin rest section at an outer larger end of the second smoothly contoured section providing a chin contact point adapted for contact with the chin of the second party to effect forward movement of the device to effect gradual pressing apart of the labia at the genital opening of the first party.

24. A stimulation device for use during sexual foreplay between a first and second party in accordance with claim 23 wherein the chin contact point is a cross piece extending across the outer larger end of the second smoothly contoured section.

25. A stimulation device for use during sexual foreplay between a first and second party in accordance with claim 23 wherein the chin contact point is a wall across 3of the outer larger end of the second smoothly contoured section.

26. An interpersonal stimulation device comprising:

(a) an arcuately contoured surface shaped portion, (b) a decreasing area trough portion, (c) the arcuately contoured surface shaped portion being attached to the decreasing area trough portion at the smaller end of the trough portion, (d) a chin contact at the larger end of the trough portion arranged to allow forward movement of the device in line with the two portions, (e) wherein the trough portion has a length from one end of the trough portion to the other end of the trough portion at least somewhat longer than the length of the tongue of an average male human, that has a length more than about 2.5 to 3 inches in length, and wherein the arcuately surface shaped portion is equipped with an electrically operated vibration means.

27. An interpersonal stimulation device comprising:

(a) an arcuately contoured surface shaped portion, (b) a decreasing area trough portion, (c) the arcuately contoured surface shaped portion being attached to the decreasing area trough portion at the smaller end of the trough portion, (d) a chin contact at the larger end of the trough portion arranged to allow forward movement of the device in line with the two portions, and (e) wherein the chin contact is a crosspiece extending across the larger end of the decreasing area trough portion.

28. A stimulation device for use during sexual foreplay comprising:

(a) a first smoothly contoured section having a shape and size adapted for placement and retention within the outer portion of the vagina of a first party, (b) a second smoothly contoured section having a generally decreasing cross sectional area with a trough-shaped depression from one end to the other on one side adapted to support and guide the tongue of a second party, (c) the first and second portions being secured to each other adjacent to the smaller end of the decreasing cross sectional area contoured section, (d) wherein the trough-shaped depression has a generally decreasing cross-sectional area over a major portion of the second smoothly contoured section, and the first and second smoothly contoured sections are connected by an intermediate section, and (e) wherein there is a chin contacting member at a larger end of the trough shaped depression in the form of a crosspiece extending from one side of the trough-shaped depression to the other.

29. A stimulation device for use during sexual foreplay comprising:

(a) a first smoothly contoured section having a shape and size adapted for placement and retention within the outer portion of the vagina of a first party, (b) a second smoothly contoured section having a generally decreasing cross sectional area with a trough-shaped depression from one end to the other on one side adapted to support and guide the tongue of a second party, (c) the first and second sections being secured to each other adjacent to the smaller end of the decreasing cross sectional area contoured section, (d) wherein the trough-shaped depression has a generally decreasing cross-sectional area over a major portion of the second smoothly contoured section, and the first and second smoothly contoured sections are connected by an intermediate section, and (e) wherein there is a chin contacting member at a larger end of the trough shaped depression in the form of a crosspiece extending from one side of the trough-shaped depression to the other and wherein various alternative contour first sections may be attached to the second section and the first section is provided with a mechanical vibration device.

* * * * *